United States Patent [19]

Olson

[11] 3,965,316

[45] June 22, 1976

[54] LOW FORCE SWITCH MECHANISM

[75] Inventor: Harry William Olson, Woodridge, Ill.

[73] Assignee: McGill Manufacturing Company, Inc., Valparaiso, Ind.

[22] Filed: Jan. 23, 1975

[21] Appl. No.: 543,537

Related U.S. Application Data

[63] Continuation of Ser. No. 394,970, Sept. 7, 1973, abandoned.

[52] U.S. Cl. ..... 200/67 D

[51] Int. Cl.[2] ..... H01H 13/36

[58] Field of Search ..... 200/67 D, 67 R; 74/100 P

[56] References Cited

UNITED STATES PATENTS

| | | | |
|---|---|---|---|
| 2,980,774 | 4/1961 | Millerwise | 200/67 D |
| 3,415,962 | 12/1968 | Krieger | 200/67 D |
| 3,809,834 | 5/1974 | Hipple | 200/67 D |

FOREIGN PATENTS OR APPLICATIONS

| | | | |
|---|---|---|---|
| 1,266,387 | 4/1968 | Germany | 200/67 D |
| 1,118,310 | 11/1961 | Germany | 200/67 D |

*Primary Examiner*—David Smith, Jr.

[57] ABSTRACT

A low force switch assembly having a single pole, double throw switch action wherein a one-piece contactor having a frame with longitudinal side members, a contact portion, a blade portion, and a pair of auxiliary lever arms are positioned within the switch housing by locating the contact portion between first and second contact members mounted to the switch housing and by anchoring the blade portion and auxiliary lever arms to points on a common terminal positioned within the switch housing and extending outwardly therefrom. The common terminal includes a pair of fulcrum extensions extending inwardly within the housing intermediate the ends of the common terminal for engaging and anchoring the auxiliary lever arms. A switch operating plunger extends outwardly from the switch housing and is engageable with the one-piece contactor. During depression of the operating plunger, the contactor is moved downwardly and the blade portion drives the contact portion to engage a selected one of the first and second contact members to complete the switch action. Upon release of the depressed plunger, the compressed lever arms bias and return the actuated plunger and the contact portion to their unactuated condition.

4 Claims, 5 Drawing Figures

LOW FORCE SWITCH MECHANISM

This is a continuation, of application Ser. No. 394,970, filed Sept. 7, 1973 now abandoned.

BACKGROUND OF THE INVENTION

Switch assemblies utilizing low force switch actions have been developed for use where it is desirable to provide precision snap action switches operable in response to a slight movement of the operating plunger and operable consistently over a long period of time. Although previous attempts to develop such low force switch assemblies have utilized a one-piece contactor blade and lever construction, such construction has resulted in a flat, horizontal contactor which has a reduced lever ratio and has required increased operating plunger forces to be necessary. Such construction has resulted in actuator force requirements far greater than is permissible for low force switch assemblies in many applications. Additionally, the design of the prior art low force switch assemblies has not been successful because the lateral friction between the operating plunger and the contactor and the walls of the switch housing has resulted in inefficient switch action.

SUMMARY OF THE INVENTION

One object of this invention is to provide an improved low force switch assembly utilizing a one-piece contactor having a frame with longitudinal side members positioned substantially normal to the transverse portion of the frame.

It is another object of this invention to provide a low force switch assembly including a one-piece contactor having a blade portion so positioned to engage the common terminal that a portion of the blade energy may be pre-loaded into the blade during assembly.

It is a further object of this invention to provide a low force switch assembly wherein the one-piece contactor has auxiliary lever arms mounted and engageable with fulcrum extensions of the common terminal to substantially increase the lever ratio and reduce the operating forces of the operating plunger to complete the switch action.

In an embodiment of this invention, the low force switch assembly includes a housing having a coverplate, a base, a switch operating plunger extending through the housing and first and second contact members mounted within the housing and extending outwardly from the end of the housing. The common terminal includes a plurality of right angle segments having one end thereof positioned within the housing and an end portion extending outwardly from the housing. Intermediate the ends of the common terminal, a pair of fulcrum extensions extend inwardly within the switch housing. The one-piece contactor includes a pair of auxiliary lever arms, a blade portion, longitudinal side members bent substantially normal to the auxiliary lever arms and a contact portion. The one-piece contactor is positioned within the switch housing such that the contact portion is located between the first and second contact members and is engageable with one of said contacts, the blade portion is anchored to the end segment of the common terminal positioned within the housing and the auxiliary levers are anchored to the fulcrum extensions, such auxiliary lever anchor points being substantially aligned with the blade portion anchor point. When the operating plunger is depressed, the plunger engages the one-piece contactor and displaces the same from its normal position. This movement of the contactor creates a tension in the blade portion such that the contact portion of the contactor is driven from the contact member normally engaged to the other contact member to complete the switch action. The resulting movement of the contact member creates a tension in the auxiliary lever arms such that when the pressure on the operating plunger is released, the one-piece contactor returns to its original position thereby returning the operating plunger to its initial position.

DETAILED DESCRIPTION

Figure 1:
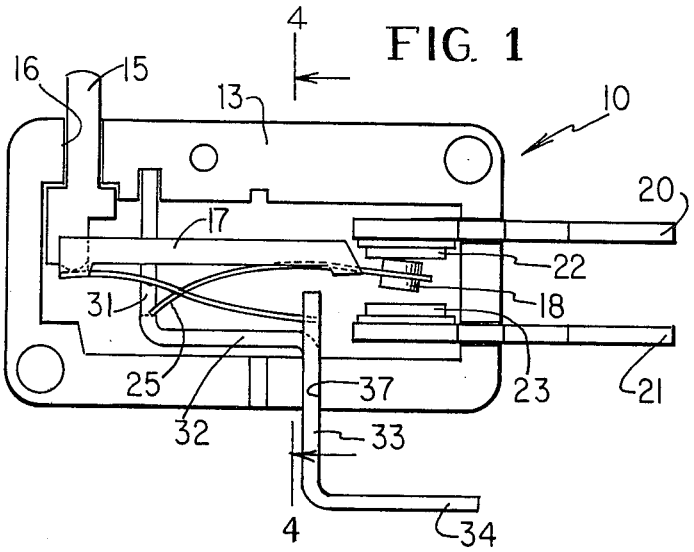
FIG. 1 is a side elevation view in cross-section showing the low force switch assembly of the invention in the unactuated condition.
Figure 2:
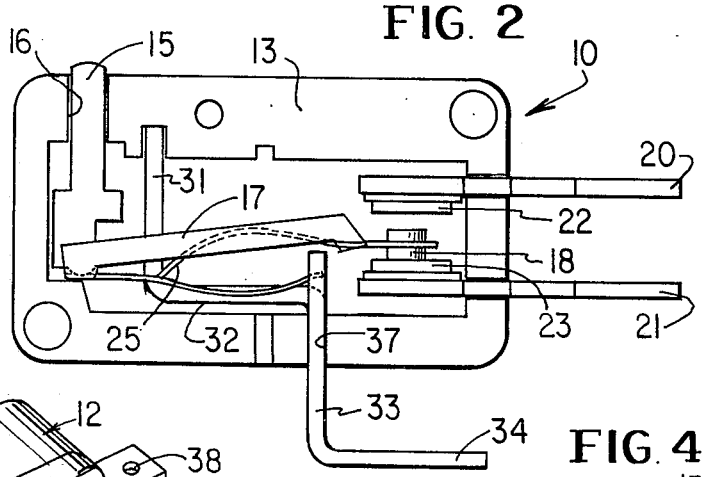
FIG. 2 is a side elevation view in cross-section showing the low force switch assembly of the invention in the actuated condition.
Figure 3:
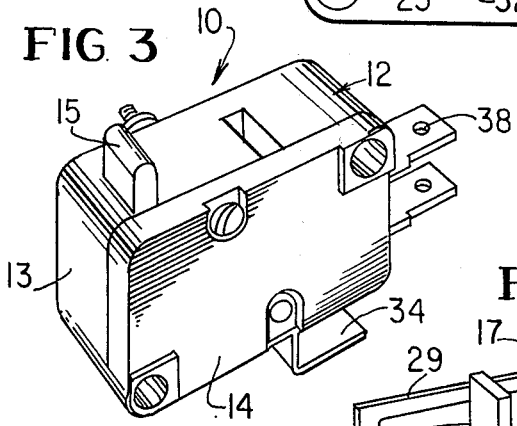
FIG. 3 is an isometric view of the low force switch assembly constructed in accordance with the invention.

In FIGS. 1, 2 and 3 there is shown a low force switch assembly which utilizes the low force switch action of the present invention. The switch assembly 10 includes a housing 12 (FIG. 3) of a molded plastic material comprised of a base 13 (FIG. 3) having a cavity therein and coverplate 14 (FIG. 3) that is secured to the base of the housing to close off the side thereof. In FIG. 1 the coverplate 14 has been removed to expose an internal cavity defined by base 13. The switch assembly 10 is a single pole, double throw device having first and second fixed contact members 20 and 21 attached to terminals which extend outwardly from the housing 12. The inner portions of contact members 20 and 21 have contact elements 22 and 23 secured to the adjacent surfaces in vertical alignment, as shown in FIG. 1.

Figure 5:
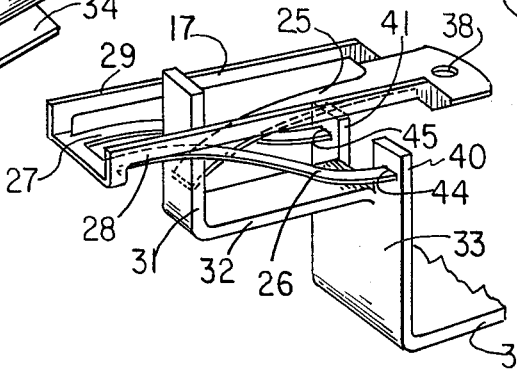
FIG. 5 is a cross-sectional plan view showing the engagement of the one-piece contactor with the fulcrum extensions and end portion of the common terminal.

A switch operating plunger 15 extends outwardly from the housing 12 through opening 16 and includes an enlarged inner portion to retain the plunger within the switch housing. The one-piece contactor 17 includes a mounted contact member 18 extending on opposite sides of one end thereof at opening 38 (FIG. 5), with said contact member 18 being positioned between the contact elements 22 and 23. The contactor 17 further includes a frame supporting the contact member 18 and having longitudinal side members 28 and 29, a blade portion 25 and a pair of auxiliary lever arms 26 and 27 (FIG. 5). A common terminal 30 is adapted to be positioned within the switch housing 12 to receive and hold in position the one-piece contactor 17. This common terminal 30 is constructed of conductive material bent at right angles at three spaced apart positions along its length to provide four functional segments 31, 32, 33 and 34. Segment 31 is anchored in notch 36 within the switch housing base 13 and segment 33 is fitted within an opening 37 in the base of the switch housing. A portion of segment 33 and the end segment 34 extend outside the switch housing 12 for connection with a suitable connector. At the junction where segment 32 makes a right angle with segment 33, a pair of fulcrum extensions 40 and 41 (FIG. 5) extend inwardly within the switch housing 12 to provide anchor means for the contactor within the switch housing.

In FIG. 5 the positioning and anchoring of contactor 17 to the common terminal 30 is shown. Intermediate between the right angle formed by segments 32 and 33 and the ends of the fulcrum extensions 40 and 41, recesses 44 and 45 are formed in such extensions. Substantially aligned with these recesses, an additional recess 47 is formed in segment 31 of the common terminal 30. These recesses in the fulcrum extensions 40 and 41 and in segment 31 provide the means for anchoring contactor 17 in operating position within the switch assembly. Thus, the blade portion 25 of the contactor 17 is anchored in recess 47, auxiliary arm 26 is anchored in recess 44 and auxiliary arm 27 is anchored in recess 45. By providing that the anchor points of the auxiliary lever arms 26 and 27 are positioned substantially in planar alignment with the anchoring position of blade 25, the pivot point of the auxiliary lever arms is positioned forwardly towards the fixed contact members thereby providing that an increased lever ratio is obtained and a reduced operating force is required by the plunger 15 to complete the switch action.

As illustrated in FIG. 1, the switch assembly comprised of the contactor 17 anchored to the common terminal 30 is inserted into the switch housing such that segment 31 of terminal 30 is anchored within notch 36 and segment 33 thereof is positioned in opening 37. When the contactor and common terminal assembly is inserted within the switch housing in operating condition, the contact member 18 is biased upwardly to effect engagement with contact element 22.

The operating plunger 15 is positioned within an opening 16 in the switch housing 12 to reset on the left hand ends of contactor 17. Inward movement of the operating plunger 15 from the unactuated position to the actuated position, drives the left hand end of contactor 17 downward whereby contact member 18 will snap from the upper stationary contact element 22 to the lower stationary contact element 23 to complete the switch action. This snap action is increased because the end of the blade portion 25 near the contact element 18 contains a straight portion or segment between the end of the contactor 17 and the blade portion 25. This segment permits a portion of the blade energy to be preloaded into the blade 25 as opposed to the overcentering direction and thereby permits a virtually tease-free contact shuttle between contact member 18 and contact elements 22 and 23.

As illustrated in FIG. 2, the plunger 15 has been fully depressed to the actuated position and the contact member 18 has moved from the contact element 22 to complete the switch action by engaging contact element 23. When the pressure is removed from the operating plunger 15, the auxiliary lever arms 26 and 27 upwardly bias the operating plunger 15 and the blade portion 25 so that the plunger will return to its upper unactuated position (FIG. 1) and the contact member 18 will disengage contact element 23 and return to engage contact element 22. Thus the switching elements again rest in their unactuated position.

Figure 4:
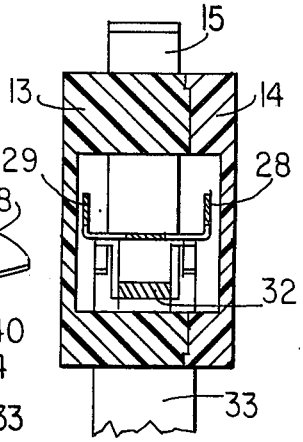
FIG. 4 is an end view in cross-section showing the assembled low force switch assembly of the invention.

One important feature of this invention is that the contactor 17 contains longitudinal side members 28 and 29 which permit a greater lever load with a more narrow cross-section. By providing that the one-piece contactor contains these longitudinal side members 28 and 29, when the operating plunger 15 is released from its actuating condition, the end of the contactor 17 applies an upper force on the plunger. Additionally, the longitudinal side members 28 and 29 provide rigidity or a stiffening to the contactor 17 which heretofore has not been present in prior art snap action switch assemblies. Furthermore, the side members eliminate any sliding friction between the contactor frame and the walls of the base and coverplate, as shown in FIG. 4.

The switch described is a low force switch assembly utilizing a one-piece contactor having reinforced longitudinal side members and integral blade and lever arms to provide a tease-free contact shuttle between contact member 18 and contact elements 22 and 23.

I claim:

1. A switch assembly including in combination:

a housing having an enclosure and a coverplate thereon, a switch operating plunger extending outwardly from said housing, first and second fixed members within said housing, at least one of which is conducting and forms a contact within said housing and a terminal extending outwardly from said housing, a common conducting terminal having a body portion positioned within said housing and an end portion extending outwardly from said housing, said body portion further having a blade anchoring part spaced a first predetermined distance from a pair of fulcrum extensions integral thereto and extending inwardly within the housing therefrom, a one-piece substantially flat, elongated conducting contactor comprising a frame supporting a contact portion, a central blade portion having a free end extending away from the contact portion on said frame, a pair of auxiliary lever arms straddling said central blade portion and having free ends extending from said frame toward the contact portion of said frame, the free ends of said central blade portion and said auxiliary lever arms being spaced apart a second predetermined distance when said contactor is unstressed, said second predetermined distance being greater than said first predetermined distance, said contactor being positioned within said housing with said contact portion between said fixed members and engaging a selected one of said members, the free end of said blade being anchored to the blade anchoring part of said body portion of said common terminal and the free ends of said lever arms each being anchored to different ones of said fulcrum extensions, said coverplate being secured to said enclosure to hold the switch assembly in assembled relation, such that said plunger is located adjacent the end of said frame remote from the contact portion so that when said plunger is actuated inwardly to engage said frame and to move said contactor, said blade is moved to drive said contact portion to engage the other of said fixed members, and said lever arms bias and return said plunger and contactor portion toward their unactuated positions.

2. The switch assembly according to claim 1 wherein said blade anchoring part of said common conducting terminal and said fulcrum extensions thereof have recesses therein adapted to receive and to anchor said blade portion and said auxiliary lever arms of said contactor within said housing.

3. The switch assembly according to claim 2 wherein all of said recesses are located in substantially the same plane.

4. The switch assembly according to claim 2 wherein said fulcrum extensions of said common conducting terminal extend inwardly intermediate the ends of such common terminal in a manner substantially parallel with said blade anchoring part of said common terminal.

* * * * *

Disclaimer 3,965,316.—*Harry William Olson*, Woodridge, Ill. LOW FORCE SWITCH MECHANISM. Patent dated June 22, 1976. Disclaimer filed Mar. 23, 1977, by the assignee, *McGill Manufacturing Company, Inc.*

Hereby enters this disclaimer to claims 1–4, inclusive, of said patent.

[*Official Gazette May 10, 1977.*]